United States Patent [19]

Jorgensen et al.

[11] Patent Number: 4,523,070

[45] Date of Patent: Jun. 11, 1985

[54] LOW PROFILE FOOD ROTATOR

[75] Inventors: Jorgen A. Jorgensen, Bloomington; Donald W. Nygren, St. Louis Park, both of Minn.

[73] Assignee: Northland Aluminum Products, Inc., Minneapolis, Minn.

[21] Appl. No.: 505,370

[22] Filed: Jun. 16, 1983

[51] Int. Cl.[3] ..... H05B 6/80; A47B 11/00

[52] U.S. Cl. ..... 219/10.55 F; 219/10.55 E; 108/20; 108/139; 99/443 R; 126/338

[58] Field of Search ..... 219/10.55 E, 10.55 F, 219/10.55 R; 99/448, 446, 444, 445, 443 R, 451, DIG. 14; 126/338 R; 108/20, 139, 142; 74/16

[56] References Cited

U.S. PATENT DOCUMENTS

| | | | |
|---|---|---|---|
| 4,216,727 | 8/1980 | Cunningham | 219/10.55 E X |
| 4,254,319 | 3/1981 | Beh et al. | 219/10.55 F |
| 4,258,630 | 3/1981 | Jorgensen et al. | 108/20 |
| 4,434,343 | 2/1984 | Bowen et al. | 219/10.55 F |
| 4,456,805 | 6/1984 | Jorgensen et al. | 219/10.55 F |

FOREIGN PATENT DOCUMENTS 460489 12/1913 France .

*Primary Examiner*—Philip H. Leung

*Attorney, Agent, or Firm*—Orrin M. Haugen; Thomas J. Nikolai; Douglas L. Tschida

[57] ABSTRACT

A mechanically-driven, low-profile, portable turntable for use in cooking ovens, especially microwave ovens, for rotating food stuffs while cooking. All moving parts, except the power spring used to drive the turntable are formed from low loss plastic and the spring is contained in a microwave reflective case to preclude overheating thereof. The low profile is achieved by providing a unique drive mechanism for the turntable in which the power spring driven gear is made to partially surround and envelop the spring case. Further, the gear train cooperating with the main power spring driven gear and with a speed-controlling governor is effectively "wrapped" about the spring case in a concentric fashion with the individual gears in the gear train being vertically overlapped.

9 Claims, 3 Drawing Figures

LOW PROFILE FOOD ROTATOR

BACKGROUND OF THE INVENTION

I. Field of the Invention:

This invention relates generally to a cooking appliance and more specifically to a food rotator for use in an oven which functions to ensure that the item being prepared will be more uniformly exposed to the infrared or microwave energy during the cooking operation.

II. Discussion of the Prior Art:

Turntables for use in an oven environment to provide more uniform cooking is an old concept. The Shaw U.S. Pat. No. 557,344 describes a turntable device having a spring motor for rotating the table and it dates back to the late 1800's. At that time, most ovens were wood or coal fired, and, as such, the heat was not evenly distributed within the oven chamber. By rotating the food while cooking, it would be more uniformly exposed to the infrared energy.

With the advent of natural gas and electric ranges, it became possible to design the burner arrangement such that the heat was uniformly distributed within the oven chamber. Hence, the need for a food rotator device was obviated. However, in the late 1940's or early 1950's when microwave ovens came into vogue, it was discovered that the microwaves are not uniformly distributed within the oven enclosure and, as a result, so-called "hot spots" developed whereby the cooking was not uniform throughout the article being heated. Thus, the turntable approach again came into popularity.

The U.S. Pat. No. 4,036,151 to Shin, describes a microwave oven having a built-in turntable structure. During the 1970's built in turntables were primarily found in microwave ovens of Japanese manufacture. United States manufacturers, however, attempted to solve the "hot spot" problem by addressing the manner in which the microwaves could be distributed within the oven cavity. So-called "mode stirring" devices were built into the ovens. This approach has not been altogether satisfactory and many thousands of microwave ovens have been sold and are in use which do not adequately distribute the microwave energy throughout the oven cavity and which do not include a built-in turntable.

Various portable food rotator devices have been devised for use in microwave ovens. The Beh et al. U.S. Pat. No. 4,254,319 describes a turntable device driven by a spring-type motor wherein all of the parts comprising the motor and escapement are fabricated from a plastic that tends not to heat up when exposed to microwave energy. This device did not become a commercial reality, it is believed, because of the inability of a plastic spring to store sufficient energy for rotating the turntable over a prolonged period.

The Cunningham U.S. Pat. No. 4,239,009 is another example of a prior art design that was commercially impractical because it employs a standard spring motor and escapement construction using metallic parts but without providing shielding of any type. As a result, when exposed to microwave energy, the metallic parts produce considerable arcing, sparking and overheating.

In accordance with our earlier invention which is described in U.S. Pat. No. 4,258,630, a solution was provided whereby metal spring motors could be placed within the microwave oven cavity without exhibiting the drawbacks attendant in the device of the Cunningham Patent. Specifically, the spring motor is disposed beneath the rotatable turntable and is contained within a smooth metallic container having no sharp edges to serve as high potential discharge points. Having solved that problem, Applicant's Assignee, Northland Aluminum Product Inc., has been highly successful in selling its MICRO-GO-ROUND ® turntable for use in microwave ovens where they do not have a built-in food rotator.

Microwave ovens for home use have a relatively small oven compartment and, as such, it is desirable that the turntable present a low profile so as not to take up room which could otherwise be used to contain the food items to be cooked. The Pomeroy et al. U.S. Pat. No. 4,330,696 attempts to address this problem by relocating the drive motor assembly so that it does not fit beneath the rotatable table itself. Instead, the motor assembly is housed separately from the turntable structure and is positioned alongside the turntable rather than beneath it. The drive assembly is coupled through a suitable spur gear to cooperate with gear teeth formed on the rim of the turntable element itself. The underlying theory in the design of the device described in the Pomeroy Patent is that the motor assembly is positioned in a corner of the microwave oven and, accordingly, is supposedly less obtrusive both in terms of occupying space which would otherwise be available for food placement and in terms of being located in a zone where microwave energy is of lowest density. In practice, however, the positioning of the drive unit alongside the turntable itself still interferes with the free rotation of certain food items when placed on the turntable beyond that which is dictated by the corners of the oven itself.

It can be seen, then, that it is desirable to provide a turntable having a low height profile but with the drive assembly for the turntable being disposed beneath the rotatable table portion of the device. In this way, large casseroles, roasts and fowl will still fit within the oven space and will rotate freely without interference from any upwardly projecting drive elements of the turntable.

SUMMARY OF THE INVENTION

The turntable design of the present invention affords these desired advantages and characteristics through a unique mechanical design arrangement in which the drive motor and its associated speed governing assembly are all fabricated from low-loss plastic materials which are generally transparent to microwaves. A metal spring is utilized to provide long periods of operation, but that spring is contained within a microwave reflective (metal) case having generally, the form, of a toroid. The opening in center of the toroidal metal case is dimensioned to receive the shaft of the main drive gear and acts as a bearing surface. The gear itself is shaped so as to overlay the top of the spring case and it has a downwardly offset rim portion such that the spring case is partially surrounded by the main drive gear. The toroidal spring case is contained within a cylindrical plastic housing having a circular bottom surface and cylindrical side walls. A top plate is affixed to the upper edges of the side walls and formed centrally through this top plate is a circular opening of a predetermined diameter which is centered over the main drive gear. The turntable on which the food items rest, then, is situated upon and driven by the rotation of the main drive gear as the energy is released from the steel spring within the spring case. The low profile feature is effectively realized through the manner in which the main drive gear is configured to partially surround the spring case, the way that the turntable is secured to the main drive gear and the manner in which the speed governing assembly is coupled to the main drive gear. In the latter regard, the gear train leading to the speed governor is comprised of a plurality of gears which are arranged in a circular arc concentric with the shaft of the main drive gear. The shafts of these gears are oriented vertically and journaled for rotation between the bottom of the housing and its top, the individual gear elements being vertically overlapped.

Following this design approach, the resulting turntable may have an overall diameter of 22.5 cm and a low-profile height of only 2.5 cm. The turntable made in accordance with our earlier Jorgenson et al. U.S. Pat. No. 4,258,630 is 5 cm high, such that the present invention affords a height reduction by a factor of two. This height dimension compares favorably with that of the turntable surface of the aforereferenced Pomeroy Patent while still disposing the drive mechanism beneath the turntable surface itself.

It is accordingly a principal object of the present invention to provide an improved turntable for rotating foods within an oven.

Another object of the invention is to provide a food rotator for microwave oven use exhibiting a low-height profile.

Still another object of the invention is to provide a portable turntable for use in a microwave oven in which all of the moving parts comprising the mechanical drive motor, excepting the power spring, are made from a low-loss, microwave transparent material and wherein said power spring is contained within a microwave reflective shield.

Yet still another object of the invention is to provide a self-contained, portable turntable for use in microwave ovens which is highly compact and immune to the exposure of microwaves.

These and other objects and advantages of the invention will become apparent to those skilled in the art from the following detailed description of a preferred embodiment when considered in conjunction with the accompanying drawings in which like numerals in the several views referred to corresponding parts.

DESCRIPTION OF THE PREFERRED EMBOIDMENT

Figure 1:
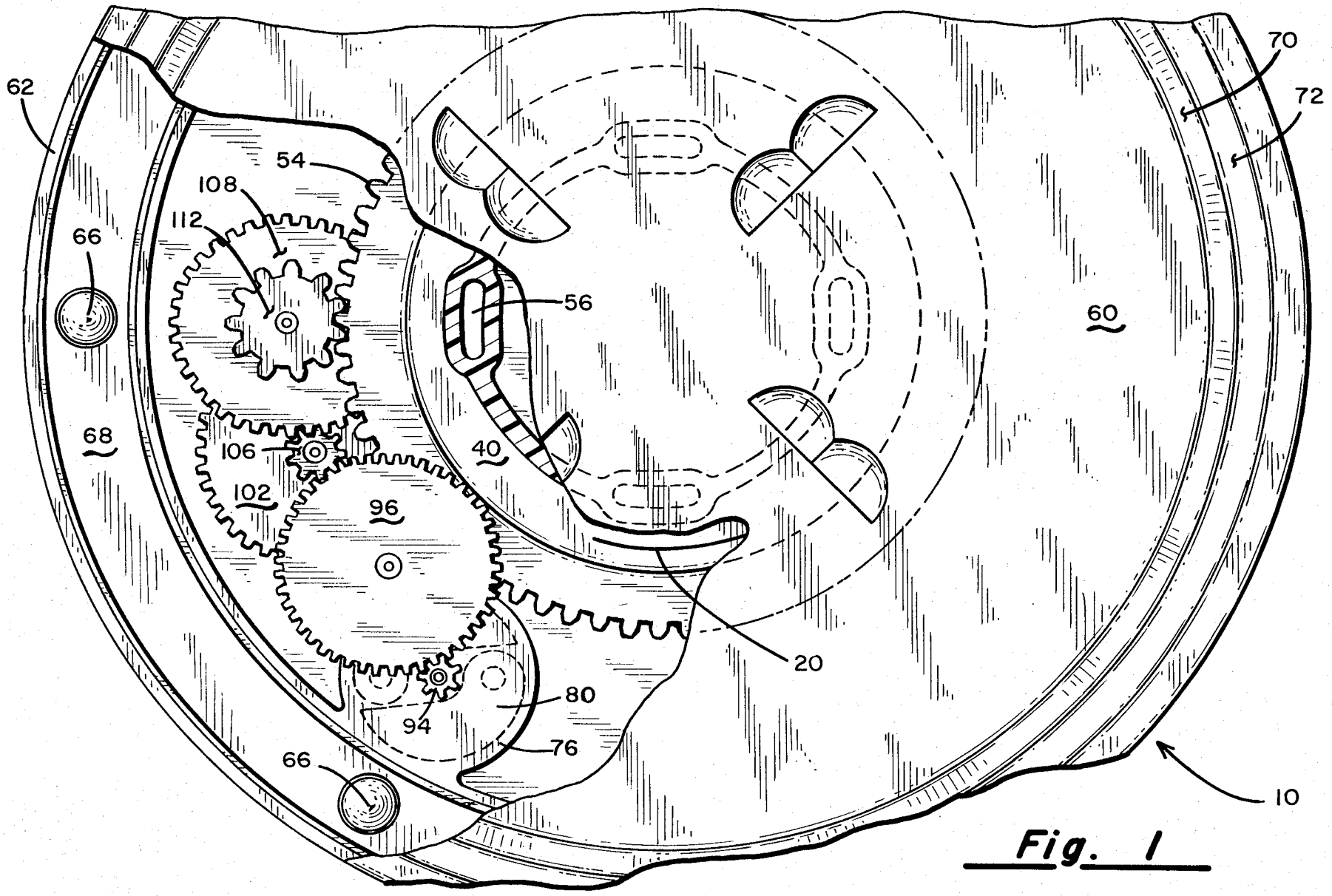
FIG. 1 is a partially broken-away plan view of a preferred embodiment showing the internal construction thereof.

Certain terminology will be used in the following description for convenience in reference only and should not be considered as limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Figure 2:
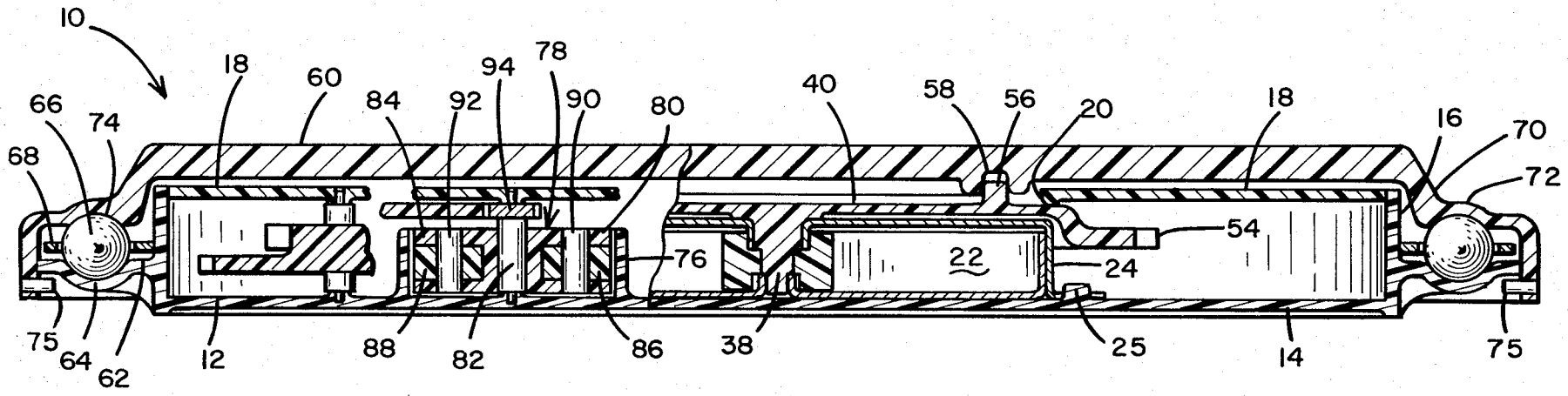
FIG. 2 is a side sectional view.

Referring to FIGS. 1 and 2, the low-profile turntable of the present invention is indicated generally by numeral 10. As can be seen, it is generally circular in its plan view and includes a cylindrical housing member 12 exhibiting a circular, planar bottom 14 surrounded by a cylindrical tubular side wall 16. Completing the housing 12 is a cover plate 18 which is affixed to the upper edge of the tubular side wall 16 and has a circular opening formed therethrough. The bottom member 14 and side wall 16 may be formed in a molding operation from a suitable plastic possessing low-loss characteristics and which is transparent to microwave energy so that it does not tend to heat up in the presence of such energy. The cover member 18 of the housing 12 may be adhesively attached to the tubular side wall 16 or, alternatively, may be thermally or chemically bonded in place.

Contained within the housing 12 is a spring motor. More specifically, and as can best be seen in FIGS. 2 and 3, it consists of a helically coiled power spring member 22 which is contained within a microwave reflective spring case 24. The case is held in position within the housing member 12 by lugs 25 projecting upward from the bottom member 14 and is seen to comprise a lower cup-shaped stamped aluminum member 26 which has a planar bottom and integrally formed, normally projecting side walls. The bottom portion of the case 26 also has a circular aperture 28 formed centrally therein and surrounding the aperture 28 and projecting upwardly from the surface 26 is a generally tubular support segment 30. With continued reference to FIG. 3, the spring case 26 is also seen to include an upper, inverted, cup-shaped member 32 which also has a generally planar base 34 but with a downwardly projecting tubular segment 36 formed thereon. The cup-shaped members 24 and 32 are dimensioned so that the member 24 will telescopingly fit within the member 32 with a predetermined close tolerance. By providing a suitable interference fit, it is not required that the two pieces be spot welded together.

The downwardly projecting tubular segment 36 and the corresponding upwardly projecting tubular segment 30 are concentrically aligned and adapted to receive the shaft 38 of the main drive gear 40.

The shaft 38 is formed such that it has a circular cross section at the top and bottom thereof in the zones in which the shaft mates with the casing projections 30 and 36 and midway between those circular segments is a segment having a square cross section. This cross section of the shaft 38 is identified by numeral 42. Contained within the generally toroidal metal case 24 is a molded plastic coupler 44 which has a cam-like periphery defining a shoulder or notch segment 46. The coupler member 44 has a square opening through it for receiving the square cross section portion of the gear shaft 38. Thus, the spring coupler 44 rotates with the shaft 38 of the main drive gear 40.

The helical power spring 22 has its outer end fixedly attached to the case 24 as at 48. Its inner end is affixed to a tin member 50 which is adapted to be engaged by the step-like notch 46 formed on the cam-like periphery of the coupler member 44.

Figure 3:
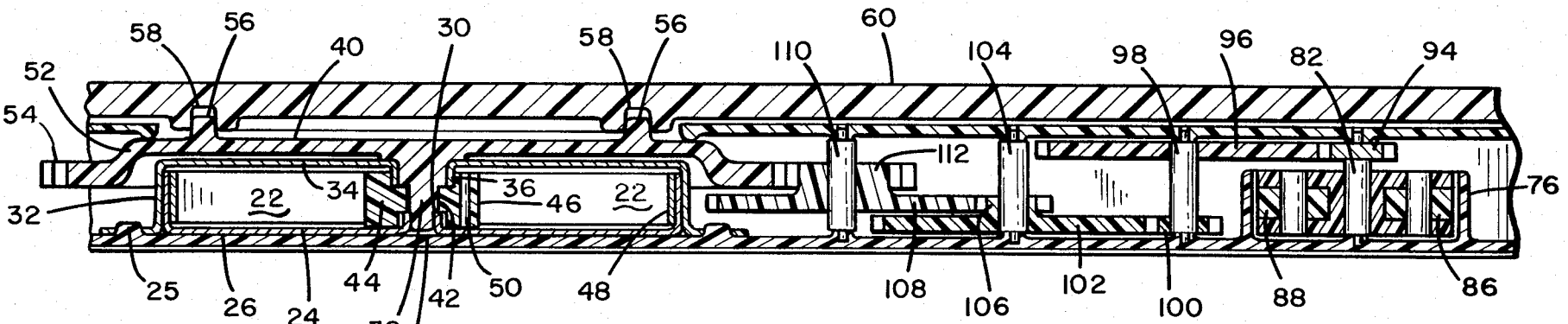
FIG. 3 is a partial developed view useful in visually the cooperative relationship between the various year coupling the main turntable drive gear to its speed governing device.

As can best be seen in FIG. 3, the main drive gear 40 is circular and the peripheral rim portion thereof is vertically offset in a downward direction as at 52 so as to overlay the spring case 24 and partially surround the side walls 32 thereof. The peripheral edge of the main drive gear 40 is provided with gear teeth as at 54. It may also be observed that the central horizontal portion of the main drive gear 40 is disposed beneath the circular opening 20 formed in the top 18 of the housing 12. Integrally formed on the top surface of the member 40 and accessible through the opening 20 are a plurality of arcuate lugs 56 which are arranged to mate with correspondingly shaped recesses 58 formed on the undersurface of the rotatable turntable member 60.

Referring next to FIG. 2, it can be seen that there is integrally formed on the exterior wall surface of the molded plastic housing member 16 a circular track member 62 containing an arcuate groove 64 in which a plurality of spherical bearing members 66 are positioned for movement therein. A predetermined desired spacing is maintained between the several ball bearings by means of a spacer ring 68 which surrounds the exterior wall 16 of the housing 12 and which has a plurality of apertures therein for freely receiving the ball bearing members 66.

The rotatable turntable member 60 has a generally planar exterior top surface upon which the items to be cooked are positioned. Proximate its outer periphery, however, the turntable 60 is provided with a downwardly depending offset 70 terminating in a generally horizontally extending rim 72, the rim 72 also being provided on its interior surface with a circular, arcuate track surface 74. The radius of the arc is such that it cooperates in a rolling fashion with the spherical bearing members 66. It can be seen, then, that the turntable 60 is supported with respect to the base by the plurality of spherical ball bearing members 66 located proximate its periphery and at the center thereof by the post 38 formed on the main drive gear 40. The turntable member 60 is held in place on the base assembly 12 by means of pins, as at 75, which extend through the member 60 at a location below the track member 62.

From what has been thus far described, it can be seen that when the turntable 60 (as viewed in FIG. 1) is rotated in the counterclockwise direction, the pin 50 secured to the inner end of the power spring 22 will engage the notch 46 on the drive coupler 44 and will cause the spring to be wound more tightly about the coupler 44. However, if the spring is unwound and then the turntable is rotated in the clockwise direction, the pin 50 will ride over the arcuate periphery of the coupler 44 and the spring cannot be unwound further. Thus, the cooperation between the pin 50 on the end of the spring and the notch 46 formed on the coupler 44 acts as a unidirectional engagement device for the spring allowing the motor to be wound up only when the turntable 60 is rotated in a predetermined direction.

If the spring is tightly wound, and the turntable is released, it would very rapidly spin under the force of the spring coupled via the member 44 to the shaft 38 of the main drive gear 40 upon which the turntable rests were it not for a speed governing mechanism also built in to the turntable of the present invention. The construction and mode of operation of the speed governing structures will now be explained.

As shown in FIGS. 1 and 2, integrally formed with and projecting upwardly from the circular bottom plate 14 of the housing 12 is a round, cup-like projection 76 in which is disposed a fly-wheel assembly 78. This assembly includes a cylindrical disk 80 secured to a shaft 82 which is journaled for rotation between the bottom member 14 of the housing 12 and its cover member 18. The disk 80 is of a predetermined thickness commensurate with the depth of the cup 76 and, approximately midway along its height dimension, it is provided with an inwardly extending peripheral slot 84 in which is positioned a pair of fly-weights 86 and 88. The shape of these fly-weights may best be seen in the view of FIG. 1. They are pivotally mounted within the peripheral slot 84 by means of pin members 90 and 92 and the fly-weights 86 and 88 are free to rotate about those pins as axles. It is also to be observed that a small spur gear 94 is secured near the upper end of the shaft 82. The teeth of the gear 94 are arranged to mesh with those on a larger diameter compound spur gear 96. The spur gear 96 is journaled for rotation on a vertical shaft 98 (FIG. 1) between the bottom member 14 of the housing 12 and its top member 18. A smaller diameter gear 100 is arranged to mate with a further compound gear 102. It, too, has a shaft 104 which is journaled for rotation between the bottom and top plates of the housing 12 and it has a smaller diameter spur gear element 106 disposed on that common shaft. The gear 106 is arranged to mesh with a large diameter compound spur gear element 108 which is disposed on a common shaft 110 with a lesser diameter gear 112, the shaft 110 again being journaled between the housing's bottom plate and top plate. The compound spur gear element 112 meshes with the teeth 54 formed on the periphery of the main drive gear 40. By properly selecting the respective diameters for the various gear elements comprising the gear train linking the main drive gear 40 to the governor assembly 78, the main drive gear 40 may be made to rotate at a slow, predetermined rate while the fly-weights 86 and 88 within the governor assembly are subjected to sufficiently high centrifugal forces so as to cause those fly weights to rotate outwardly from the peripheral slot formed in the fly-wheel 80 so as to contact and rub against the interior walls of the cup-like projection 76. The resulting frictional forces, again acting through the gear train, will regulate the speed at which the main drive gear and the turntable attached to it may turn.

In constructing the preferred embodiment of the present invention, all of the parts used therein, except the spring 22 and the spring case 24, are formed from low-loss dielectric materials which are generally transparent to microwave energy. The spring itself, being made from steel and having closely wound convolutions, would normally be expected to heat excessively in the presence of microwave energy. However, because the spring 22 is contained within a microwave reflective metal (aluminum) housing, and that housing is free from sharp edges, the spring is adequately shielded from microwaves and, accordingly, does not overheat.

Because of the manner in which the main drive gear 40 is made to overlay and partially surround the spring case 24, and because of the manner in which the various gears in the compound gear train coupling the main drive gear to the governor assembly are disposed in a generally circular arc concentric with the center point of the turntable and journaled between the top and bottom members of the housing 12, a very low profile turntable results.

The invention has been described herein in considerable detail in order to comply with the Patent Statutes and to provide those skilled in the art with the information needed to apply the novel principles, and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A portable turntable for use in a microwave oven, comprising:

(a) a generally cylindrical housing member having a planar bottom, a cylindrical side wall projecting upwardly therefrom and an annular cover joined to the upper edge of said side wall defining a central opening in the top of said cylindrical housing;

(b) a toroidal spring case secured to said planar bottom of said housing member, a central opening in said toroidal spring case, said spring case central opening being of a predetermined diameter;

(c) a first gear member having gear teeth on the peripheral edge thereof and a central shaft projecting from a first major surface thereof, said shaft being journaled for rotation within said central opening in said toroidal spring case;

(d) a spiral power spring disposed in said toroidal spring case;

(e) means securing one end of said power spring to said spring case and means releasably connecting the other end of said power spring to said central shaft;

(f) a generally circular turntable member concentrically attached to a second major surface of said first gear member and rotatable therewith;

(g) a gear train comprising a plurality of overlapping gear elements journaled for rotation about vertical axes between said planar bottom and said annular cover of said generally cylindrical housing, one of said gear elements cooperating with said gear teeth on said first gear member; and (h) means coupled to said gear train for regulating the speed of rotation of said first gear member.

2. The portable turntable as in claim 1 wherein said first gear member includes an integrally formed, downwardly offset, peripheral edge portion, said gear teeth being formed on the edge surface of said offset peripheral edge portion.

3. The portable turntable as in claim 2 wherein said spring case is at least partially surrounded by said first gear member.

4. The portable turntable as in claim 1 wherein said means for regulating the speed of rotation of said first gear means comprises:

(a) a fly-wheel member secured to a shaft journaled for rotation about a vertical axis between said planar bottom and said annular cover to said housing, said shaft being drivingly coupled to said gear train; and (b) a plurality of fly-weights pivotally coupled to said fly-wheel member and displaceable under centrifugal forces to frictionally engage a surface fixed to said planar bottom of said housing.

5. The portable turntable as in claim 1 and further including:

(a) a circular track affixed to the exterior surface of said cylindrical side wall of said housing; and (b) bearing means disposed in said track and cooperating with said circular turntable member proximate the peripheral edge thereof.

6. The turntable as in claim 1 wherein said spring case is made from a microwave reflective material.

7. The turntable as in claim 6 wherein said microwave reflective material is aluminum.

8. The turntable as in claim 1 wherein said means releasably connecting the other end of said spring to said central shaft comprises a unidirectional coupling means for winding up said power springs only when said turntable member is manually rotated in a predetermined direction.

9. The turntable as in claim 1 wherein said vertical axes of said plurality of gear elements in said gear train form a locus of points defining a generally circular arch concentric with said central shaft of said first gear member.

* * * * *